US005713656A

United States Patent [19]

Lin

[11] Patent Number: 5,713,656

[45] Date of Patent: Feb. 3, 1998

[54] SCREW DRIVER HAVING A LIGHT DEVICE

[76] Inventor: Ching Chou Lin, No. 150, Sec. 3, Chung San Road, Wu Zh Hsiang, Taichung Hsien, Taiwan

[21] Appl. No.: 719,430

[22] Filed: Sep. 25, 1996

[51] Int. Cl.[6] ..... B25B 23/18

[52] U.S. Cl. ..... 362/120; 362/119; 362/187

[58] Field of Search ..... 362/102, 109, 362/118, 119, 120, 187; 81/177.4

[56] References Cited

U.S. PATENT DOCUMENTS

| | | | |
|---|---|---|---|
| 2,706,769 | 4/1955 | Cook | 362/120 |
| 2,773,974 | 12/1956 | Markett | 362/120 |
| 3,603,782 | 9/1971 | Wortmann | 362/120 |
| 4,283,757 | 8/1981 | Nalbandian et al. | 362/120 |
| 4,964,024 | 10/1990 | Tsay | 362/118 |
| 5,577,829 | 11/1996 | Hall | 362/119 |

FOREIGN PATENT DOCUMENTS

| | | | |
|---|---|---|---|
| 1020623 | 11/1952 | France | 362/120 |

*Primary Examiner*—Alan Cariaso
*Attorney, Agent, or Firm*—Charles E. Baxley, Esq.

[57] ABSTRACT

A screw driver includes a handle having a casing for receiving batteries. A switch is electrically connected to the battery. A socket is engaged in the handle for receiving a lamp. A transparent block is engaged in the front end of the handle for engaging with a driving tool. A ferrule is rotatably engaged to the handle for engaging with and for retaining the transparent block in place. A reflector is engaged around the lamp and a spring may bias may bias the reflector away from the socket for adjusting the light beam of the lamp.

2 Claims, 5 Drawing Sheets

SCREW DRIVER HAVING A LIGHT DEVICE

BACKGROUND OF THE INVENTION

1. Field of the Invention

The present invention relates to a screw driver, and more particularly to a screw driver having a light device.

2. Description of the Prior Art

Typical screw drivers comprise a handle for engaging with a driving stem and for driving fasteners. No light device is provided for illumination purposes such that the screw driver may not be easily used in the dark.

The present invention has arisen to mitigate and/or obviate the afore-described disadvantages of the conventional screw drivers.

SUMMARY OF THE INVENTION

The primary objective of the present invention is to provide a screw driver having a light device for allowing the screw driver to be used in the dark.

In accordance with one aspect of the invention, there is provided a screw driver comprising a handle including a bore formed therein, the handle including a front portion and a rear portion, a casing engaged in the bore of the handle and engaged in the rear portion of the handle, at least one battery engaged in the casing, a cap secured to the rear portion of the handle, a switch means engaged in the cap and electrically connected to the battery, a socket engaged in the bore of the handle, a lamp secured in the socket and electrically connected to the battery, a transparent block engaged in the bore of the handle and engaged in the front portion of the handle, the transparent block including an engaging orifice formed therein for engaging with a driving tool, and a ferrule rotatably engaged to the front portion of the handle for engaging with and for retaining the transparent block in place.

A reflector is engaged in the bore of the handle and disposed between the socket and the transparent block and engaged around the lamp, and a spring means may bias the reflector away from the socket, the reflector is allowed to be moved away from the socket by the biasing means for adjusting a light beam of the lamp when the ferrule is rotated relative to the handle.

The handle includes a longitudinal rib formed therein, the casing includes a groove for engaging with the longitudinal rib of the handle for preventing the casing from rotating relative to the handle.

The casing includes a cavity for receiving the battery, the casing includes at least one first channel formed therein for engaging with at least one first conductor and for electrically connecting the battery to the switch means, the casing includes at least one second channel formed therein for engaging with at least one second conductor and for electrically connecting the battery to the lamp.

The socket includes two holes for engaging with two prongs of the lamp, and includes two conductors for electrically connecting to the prongs of the lamp, the conductors each includes a cylindrical leg for engaging with the prong of the lamp.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
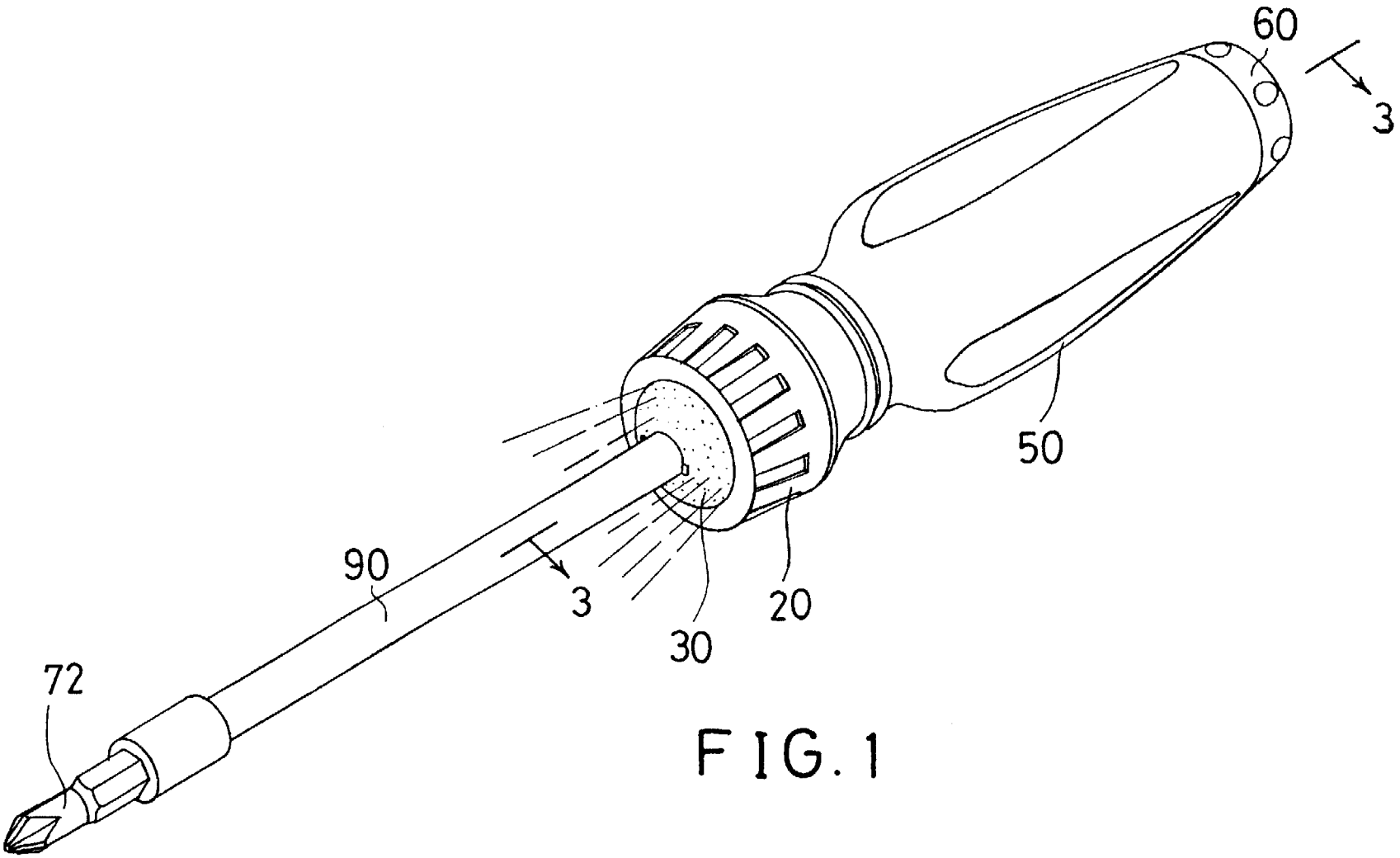
FIG. 1 is a perspective view of a screw driver in accordance with the present invention.
Figure 2:
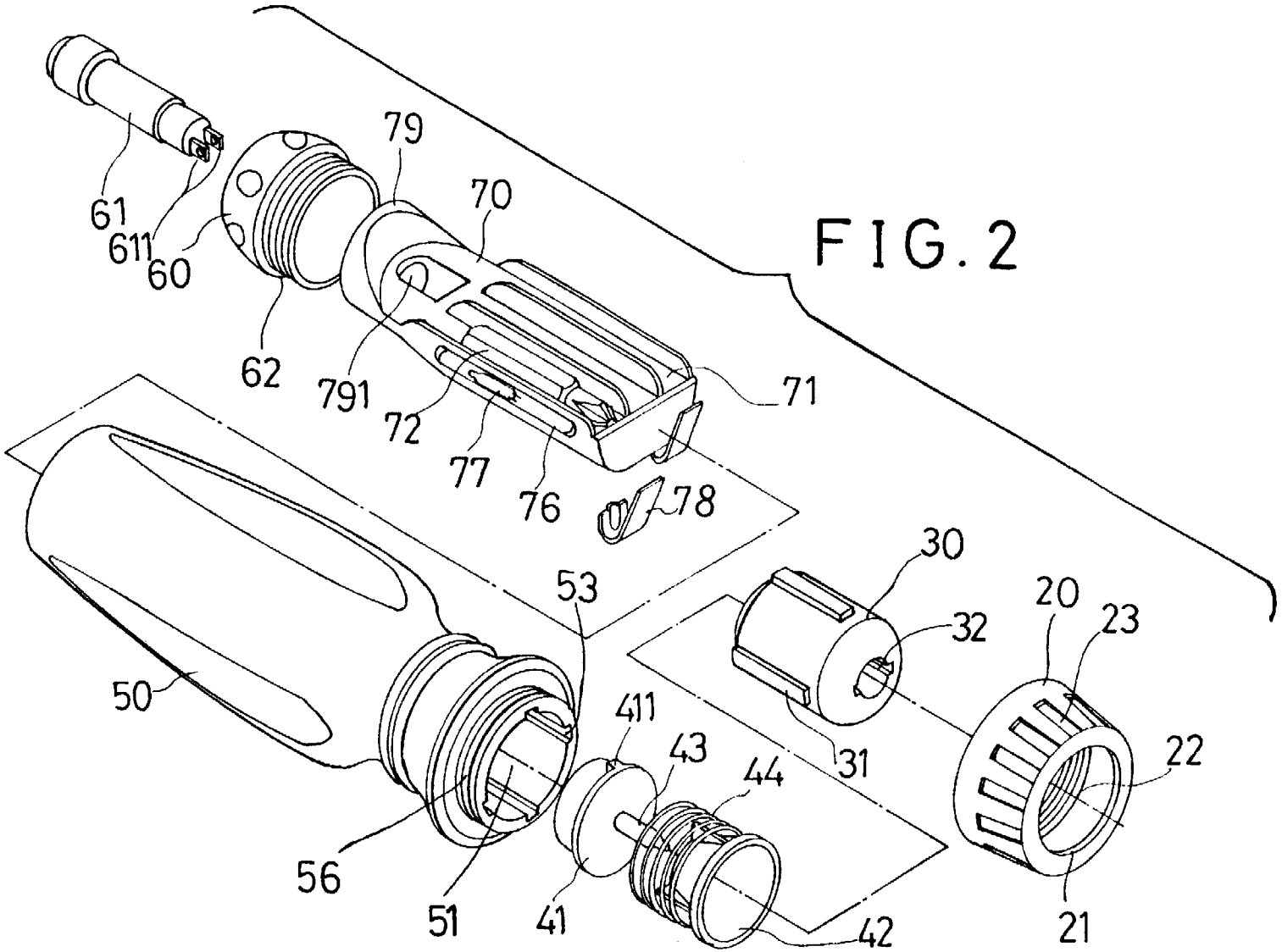
FIG. 2 is an exploded view of the screw driver.
Figure 3:
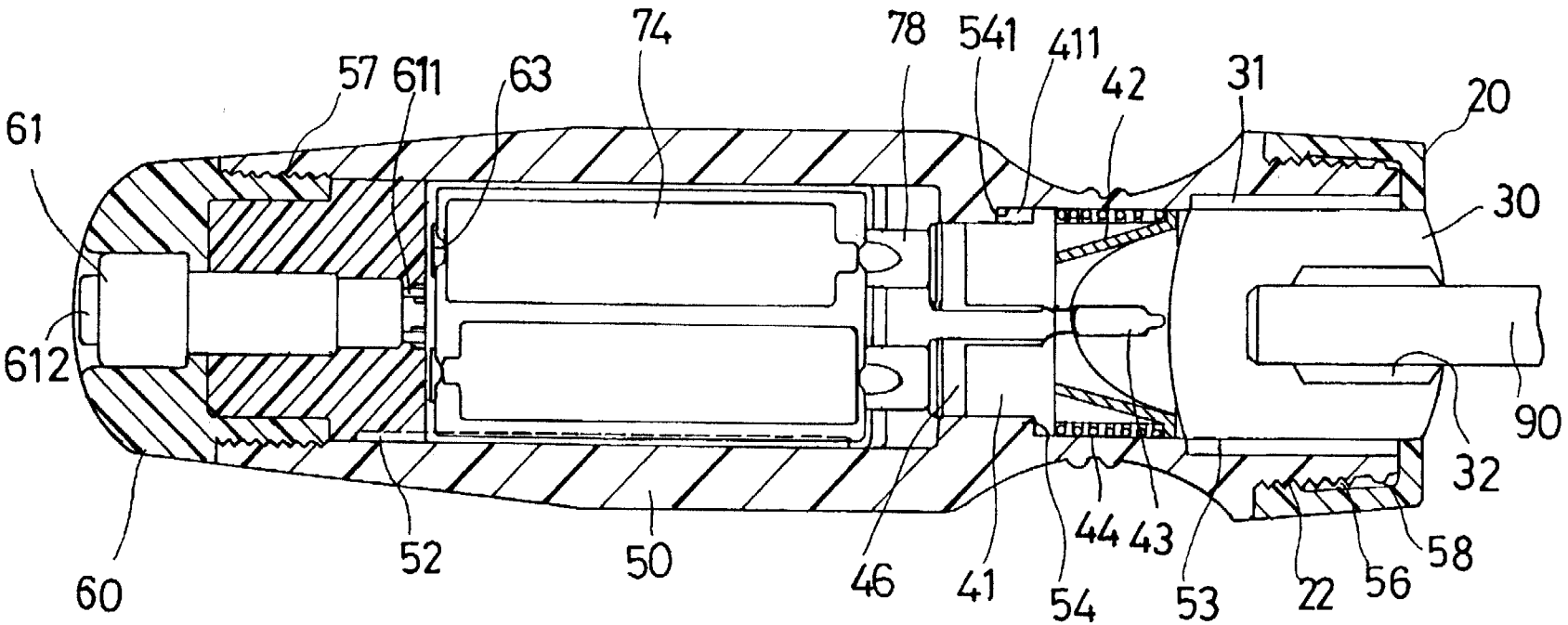
FIG. 3 is a cross sectional view taken along lines 3—3 of FIG. 1.

Referring to the drawings, and initially to FIGS. 1 to 3, a screw driver in accordance with the present invention comprises a handle 50 including a bore 51 formed therein for engaging with a light device therein. The handle 50 includes an outer thread 56 formed in the front end for engaging with an inner thread 22 of a ferrule 20 which includes a coarse outer surface 23 for facilitating the rotation of the ferrule 20 and which includes an annular flange 21 extended radially inward therefrom. The handle 50 includes an inner thread 57 formed in the rear end for engaging with an outer thread 62 of a cap 60. A switch 61 is secured in the cap 60 and includes two contacts 611 engaged in the handle 50 and includes a press button 612 for operating the switch 61.

Figure 5:
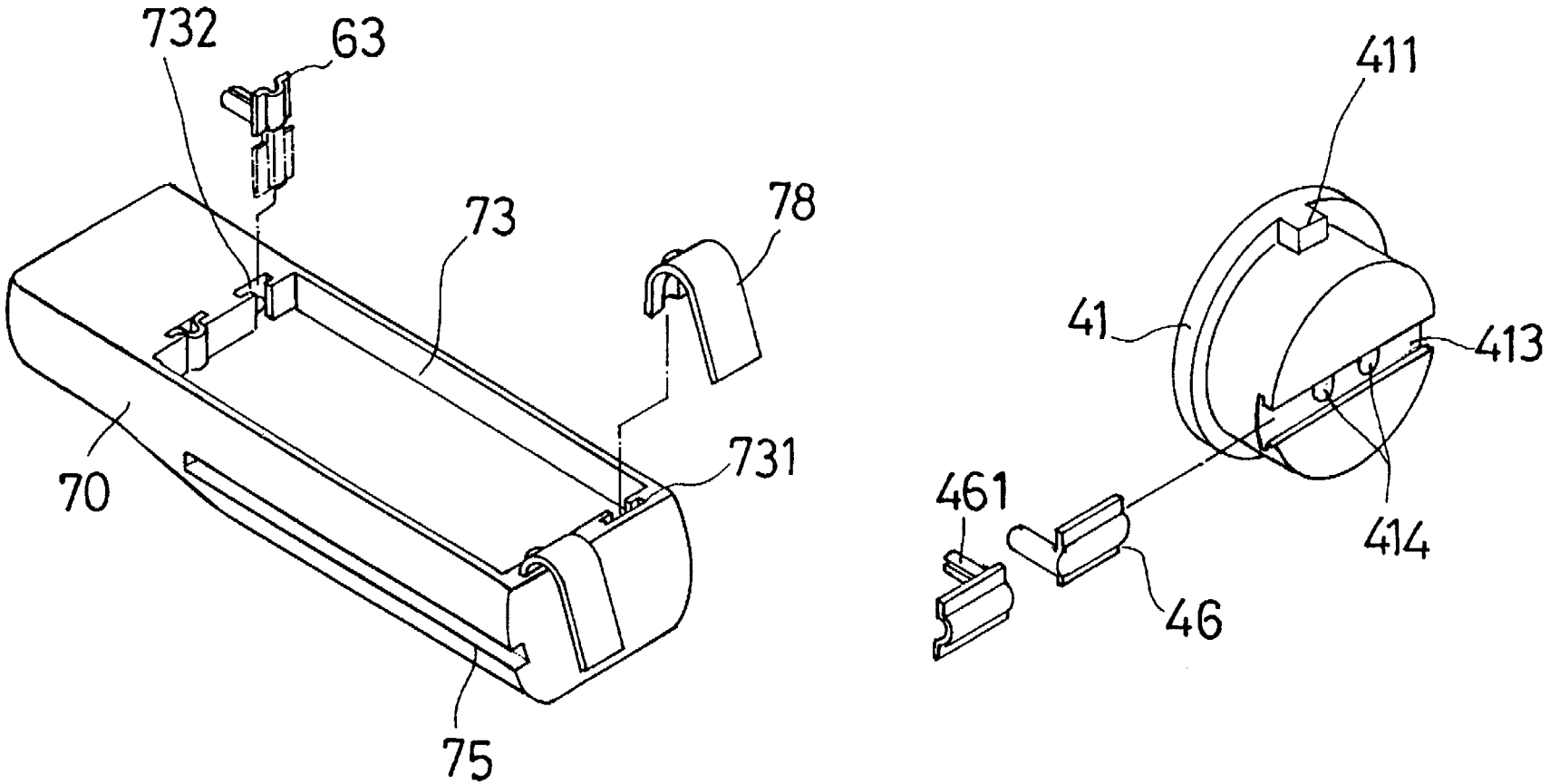
FIG. 5 is a partial exploded view illustrating the interior of the screw driver.

A casing 70 is engaged in the rear portion of the handle 50 and includes one or more recesses 71 for engaging with tool bits 72 (FIG. 2) and includes one or more depressions 76 for engaging with spare lamps 77 FIG. 2). The rear portion 79 of the casing 70 includes a hole 791 for engaging with the switch 61 (FIG. 3). As shown in FIG. 5, the casing 70 includes a cavity 73 formed in the bottom portion for receiving one or more batteries 74 therein. Two conductors 63 are engaged in the channels 732 of the casing 70 for electrically coupling the contacts 611 of the switch 61 to the case electrodes of the batteries 74 (FIG. 3). Two further conductors 78 are engaged in the channels 731 of the casing 70 for engaging with the center electrodes of the batteries 74 (FIG. 3). The casing 70 includes a groove 75 (FIG. 5) for engaging with a longitudinal rib 52 (FIG. 3) of the handle 50 for preventing the casing 70 from rotating relative to the handle 50.

Figure 4:
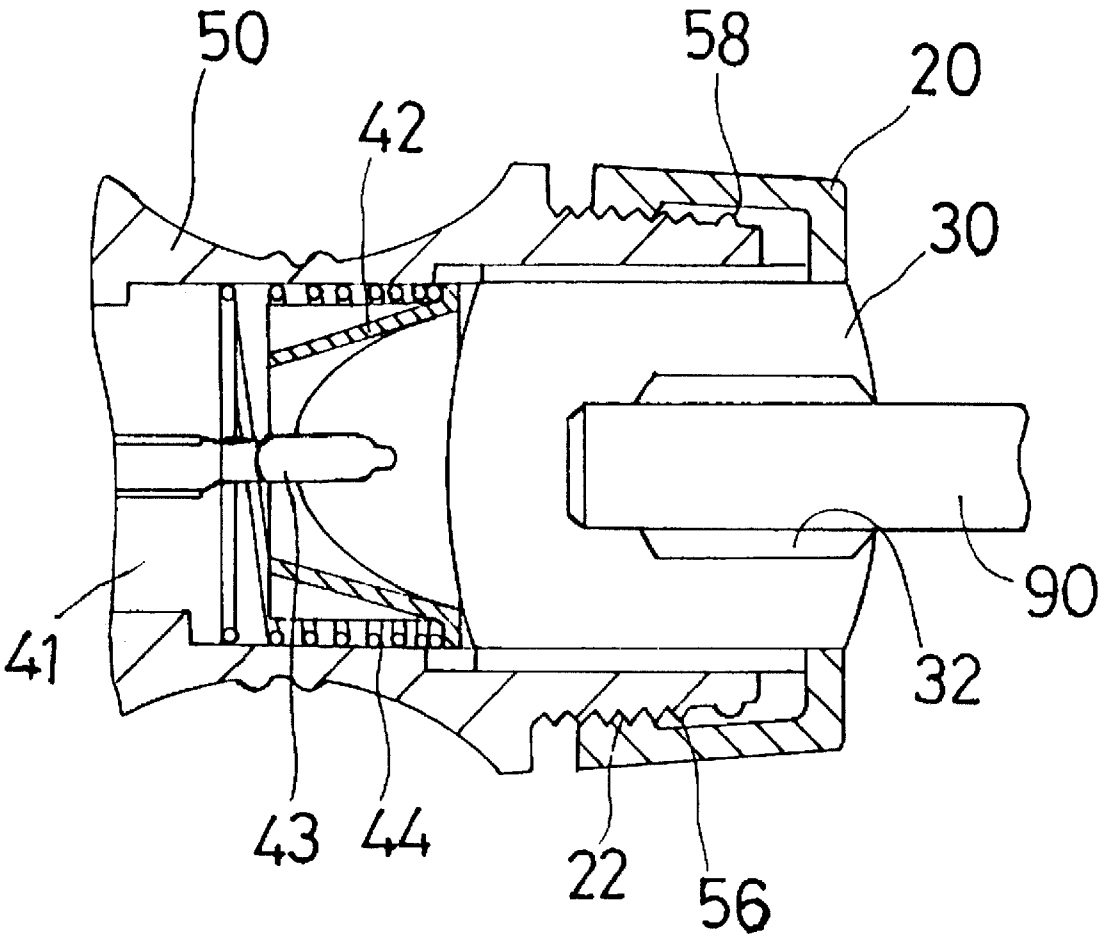
FIG. 4 is an enlarged partial cross sectional view illustrating the operation of the light device.

A socket 41 is engaged in the handle 50 for receiving a lamp 43 therein and includes a key 411 for engaging with a notch 541 of an annular swelling 54 which is formed in the handle 50 (FIG. 3), for stably positioning the socket 41 in the handle 50. The socket 41 includes two holes 414 (FIG. 5) for engaging with the prongs of the lamp 43 and includes a channel 413 for securing two conductors 46 which electrically couples the conductors 78 to the lamp 43 (FIG. 3). The conductors 46 each includes a cylindrical leg 461 for engaging with the prongs of the lamp 43. A reflector 42 is engaged in the handle 50 and engaged around the lamp 43 (FIGS. 3, 4). A spring 44 is engaged between the socket 41 and the reflector 42 for biasing the reflector 42 away from the socket 41 and for adjusting the light beam of the lamp 43. A transparent block 30 is engaged in the front end of the bore 51 of the handle 50 and includes one or more ribs 31 for engaging with the corresponding slots 53 (FIG. 2) and for preventing the block 30 from rotating relative to the handle 50. The block 30 includes an engaging orifice 32 for engaging with a driving tool 90 which may engage with a tool bit 72 for driving a fastener. The annular flange 21 of the ferrule 20 may engage with the block 30 (FIG. 3) for securing the block 30 in place.

As best shown in FIGS. 3 and 4, when the ferrule 20 is rotated relative to the handle 50, the reflector 42 may be moved away from the socket 41 by the spring 44 for adjusting the light beam of the lamp 43. It is preferable that an enlarged annular projection 58 is formed on the front end of the handle 50 for engaging with the ferrule 20 and for preventing the ferrule 20 from disengaging from the handle 50 easily and quickly. The ferrule 20 may be moved over the enlarged annular projection 58 and may be disengaged from the handle 50 when a larger rotational force is applied to the ferrule 20. The light generated by the lamp 43 may emit out of the handle 50 via the transparent block 30.

Accordingly, the screw driver in accordance with the present invention includes a light device for allowing the screw driver to be used in the dark.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screw driver comprising:

a handle including a bore and including a front portion and a rear portion, a casing engaged in said bore of said handle and engaged in said rear portion of said handle, said casing including a cavity for receiving at least one battery and including at least one recess for receiving tool bits, means engaging with said handle and said casing for guiding said casing to slide along said handle and for preventing said casing from rotating relative to said handle, a cap secured to said rear portion of said handle, a switch means engaged in said cap and electrically connected to said battery, a socket engaged in said bore of said handle, a lamp secured in said socket and electrically connected to said battery, a transparent block engaged in said bore of said handle and engaged in said front portion of said handle, said transparent block including an engaging orifice formed therein for engaging with a driving tool, a ferrule rotatably engaged to said front portion of said handle for engaging with and for retaining said transparent block in place, a reflector engaged in said bore of said handle and disposed between said socket and said transparent block and engaged around said lamp, and means for biasing said reflector away from said socket and for allowing said reflector to be moved away from said socket by said biasing means for adjusting a light beam of said lamp when said ferrule is rotated relative to said handle, said casing including at least one first channel for engaging with at least one first conductor and for electrically connecting said battery to said switch means, said casing including at least one second channel for engaging with at least one second conductor and for electrically connecting said battery to said lamp.

2. A screw driver according to claim 1, wherein said socket includes two holes for engaging with two prongs of said lamp, and includes two conductors for electrically connecting to said prongs of said lamp, said conductors each includes a cylindrical leg for engaging with said prong of said lamp.

* * * * *